US005325960A

United States Patent [19]

Sims

[11] Patent Number: 5,325,960

[45] Date of Patent: Jul. 5, 1994

[54] WATCH DISPLAY PACKAGE

[75] Inventor: Jack Sims, North Providence, R.I.

[73] Assignee: International Packaging Corporation, Pawtucket, R.I.

[21] Appl. No.: 33,021

[22] Filed: Mar. 18, 1993

[51] Int. Cl.[5] ..... B65D 85/40

[52] U.S. Cl. ..... 206/45.19; 206/45.31; 206/301; 229/115

[58] Field of Search ..... 206/6.1, 45.14, 45.19, 206/45.31, 301, 566; 229/115

[56] References Cited

U.S. PATENT DOCUMENTS

| | | | |
|---|---|---|---|
| 1,909,020 | 5/1933 | Shields . | |
| 1,966,662 | 7/1934 | Downs et al. . | |
| 2,178,652 | 11/1939 | Shields . | |
| 4,011,942 | 3/1977 | Crosslen | 206/45.14 |
| 4,034,849 | 7/1977 | Zakrajsek . | |
| 4,121,752 | 10/1978 | Ravotto et al. | 229/115 |
| 4,199,059 | 4/1980 | Maroszek | 206/566 |
| 4,211,322 | 7/1980 | Crescenzi et al. . | |
| 4,216,858 | 8/1980 | Beauchamp . | |
| 4,830,181 | 5/1989 | Hartman . | |

FOREIGN PATENT DOCUMENTS

| | | | |
|---|---|---|---|
| 2931047 | 2/1980 | Fed. Rep. of Germany | 206/45.13 |

*Primary Examiner*—Jimmy G. Foster

*Attorney, Agent, or Firm*—Salter, Michaelson & Benson

[57] ABSTRACT

A watch display package includes a wedge-shaped housing which is formed from a folded paperboard blank, and an easel-like display member, which is also made of folded paperboard. The housing has an inclined front panel and a display opening in the front panel. The display member is inserted into the housing and it is operative for holding a watch with the face thereof aligned with the display opening. The housing is further provided with a hinged panel that may be positioned to cover the display opening in a shipping mode. In a display mode, the panel may be bent rearwardly and releasably secured in its rearwardly bent portion so that the watch is readily viewable through the display opening.

18 Claims, 2 Drawing Sheets

WATCH DISPLAY PACKAGE

BACKGROUND OF THE INVENTION

The instant invention relates to package constructions and more particularly to a watch display package that is constructed by folding a paperboard blank into a wedge-shaped housing having a display opening.

Wristwatch display packages for alternatively displaying and enclosing a wristwatch have heretofore been known in the art. For example, the U.S. patents to Shields U.S. Pat. No. 1,909,020; Downs et al U.S. Pat. No. 1,966,662; Shields U.S. Pat. No. 2,178,652; Zakrajsek U.S. Pat. No. 4,034,849; Beauchamp U.S. Pat. No. 4,216,858; and Hartman U.S. Pat. No. 4,830,181 are representative of such display packages.

Folded paperboard package constructions have also been known in the art. In this regard, the U.S. patent to Crescenzi et al U.S. Pat. No. 4,211,322 represents the closest prior art to the subject invention of which the applicant is aware. The Crescenzi patent discloses a self-joined interlocking container that functions both as a shipping container and as a display container. The top portion of the container is removable, and the sides decline towards the front of the package to facilitate display of the contents thereof. The container is formed so that the raw edges along the front and sides are hidden.

SUMMARY OF THE INVENTION

The instant invention provides a paperboard package construction for alternatively displaying and enclosing a wristwatch.

Briefly, the package construction comprises a wedge-shaped housing which is formed from a folded paperboard blank and an easel-like display member which is also formed from a folded paperboard blank. The wedge-shaped housing has an inclined front panel having a display opening formed therein. The easel-like display member is inserted into the housing, and it is operative for holding a watch with the face thereof visible through the display opening. The housing is further provided with a cover flap which is hingeably movable between a shipping or closed position and a display or open position. In the closed position, the cover flap lies over the front panel so as to cover the display opening, and in the open position, the cover flap is bent rearwardly and detachably secured to a rear panel of the housing so that the watch is viewable through the display opening.

Accordingly, it is an object of the instant invention to provide a package construction that is operative for alternatively displaying and enclosing a wristwatch, and that is constructed entirely from folded blanks of paperboard or the like.

It is another object of the invention to provide a watch display package that is formed by folding a paperboard blank into a housing having an inclined front panel and a display opening in the front panel.

It is still another object to provide an easel-like member for a display package which is operative for holding a watch with the face thereof exposed through a display opening.

It is yet another object to provide an easel-like member which is formed from a folded paperboard blank.

It is a further object to provide a watch display package having a cover flap that may be positioned to cover the display opening in a shipping mode, and which may be bent rearwardly so that the watch is viewable through the display opening in a display mode.

It is another object to provide a watch display package of the character described that is relatively simple and inexpensive to make and assemble.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
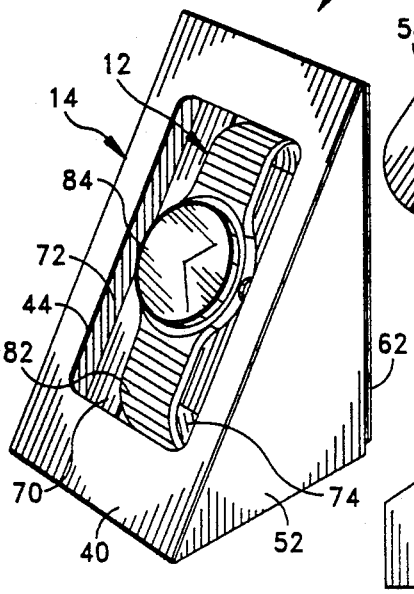
FIG. 1 is a front perspective view of the watch display package of the instant invention with the cover panel secured in the open position.

Referring now to the drawings, the instant invention is illustrated and generally indicated at 10 in FIGS. 1, 2, 6, and 7. As will hereinafter be more fully described, the instant invention 10 is operative for alternatively displaying and enclosing a wristwatch generally indicated at 12. The watch display package 10 comprises a wedge-shaped housing generally indicated at 14 that is formed from a folded paperboard blank generally indicated at 16 in FIG. 3, and an easel-like display member generally indicated at 18 which is formed from a folded paperboard blank generally indicated at 20 in FIG. 5.

Figure 3:
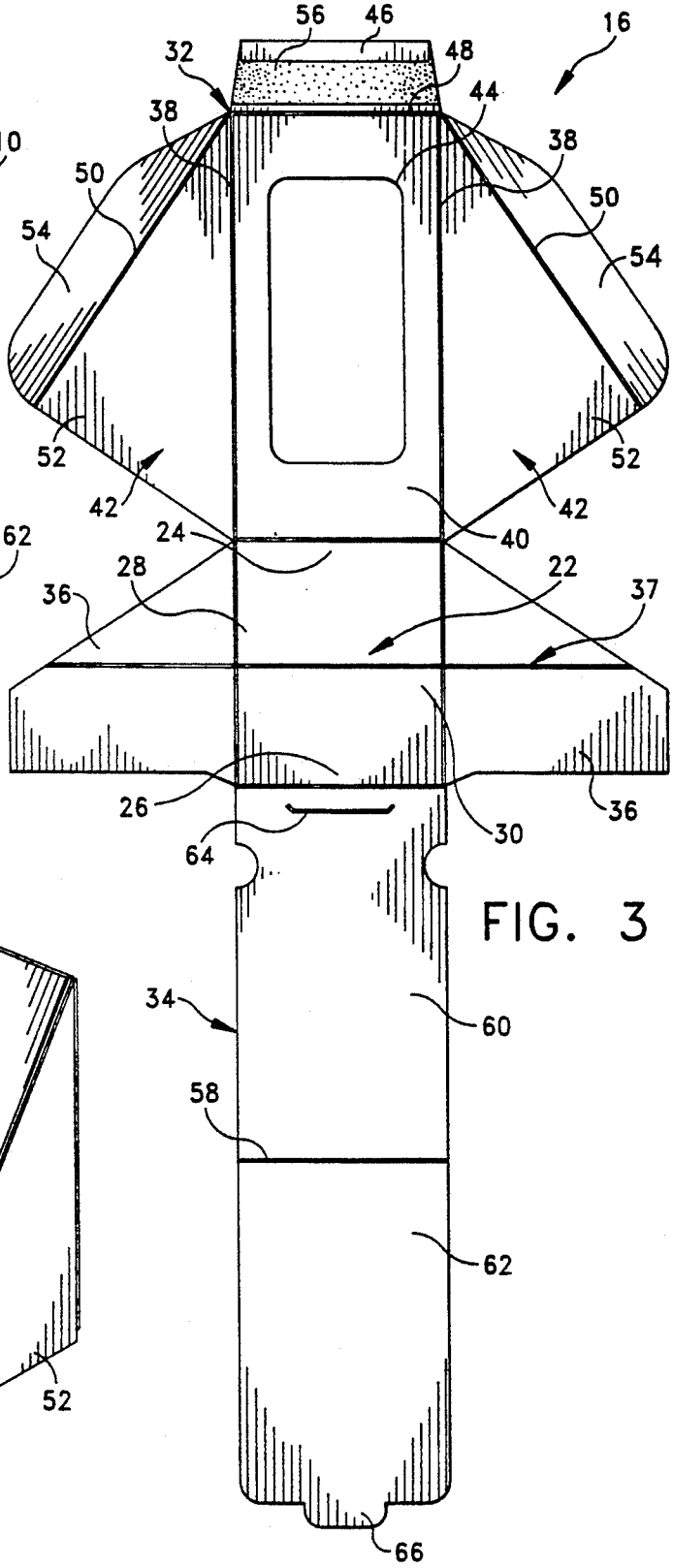
FIG. 3 is a plan view of the paperboard blank which is folded to form the housing of the display package.
Figure 2:
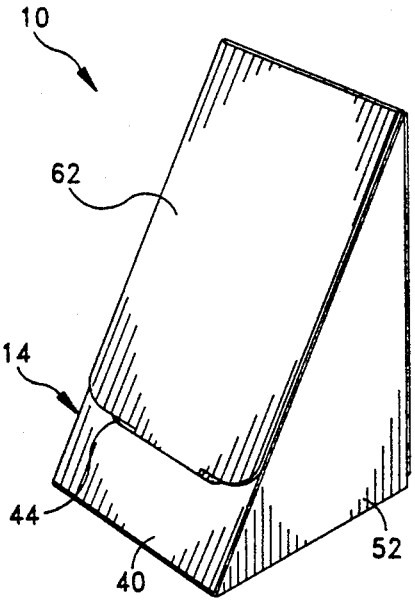
FIG. 2 similar view thereof with the cover panel secured in the closed position.

Referring now to FIG. 3, the paperboard housing blank 16 comprises a base panel generally indicated at 22 having first and second ends, 24 and 26, respectively, and opposite sides, 28 and 30 respectively, a front portion generally indicated at 32 which extends outwardly from the first end 24 of the base panel 22, a rear portion generally indicated at 34 which extends outwardly from the second end 26 of the base panel 22, and two wing-shaped panels 36 which extend outwardly from the opposite sides 28 and 30, of the base panel 22. The base panel 22 and wing-shaped panels 36 include a lateral crease line 37 which is provided for folding the blank 16 substantially in half. The front portion 32 includes two parallel crease lines 38 which divide the front portion into a rectangular front panel 40, and two triangular side portions generally indicated at 42. The front panel 40 includes a rectangular display opening 44, and a top flap 46 which is separated from the front panel 40 by a lateral crease line 48. The side portions 42 each include an angled crease line 50 which divides the side portions 42 into side panels 52 and side flaps 54. The top flap 46 has an adhesive 56 applied on one side thereof. The rear portion 34 includes a lateral crease line 58 which defines a rectangular rear panel 60 and a rectangular cover panel 62. The rear panel 60 includes a slot 64 formed therein adjacent the base panel 22. The cover panel 62 includes a tab 66 at the terminal end thereof.

Figure 6:
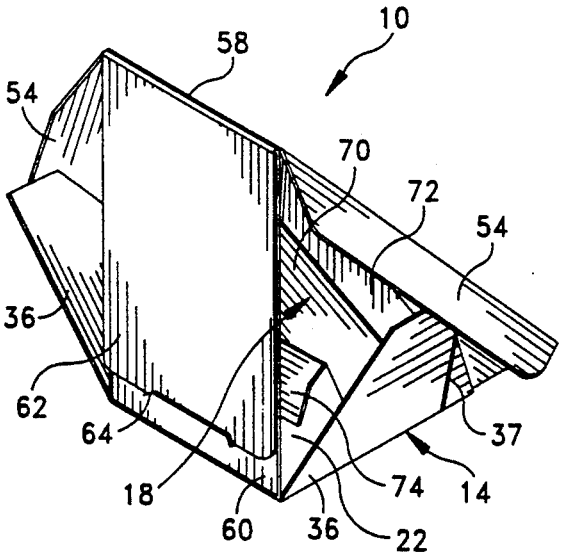
FIG. 6 is a rear perspective view of the watch display package with the side panels partially unfolded.

To form the wedge shaped housing 14 from the blank 16, the blank 16 is first laid out with the adhesive .56 on the top flap 46 facing downwardly, and then the top flap 46 is reversely bent so that the adhesive 56 faces upwardly. The blank 16 is then folded in half along crease line 37 and the rear panel 60 is secured to the adhesive 56 adjacent the crease line 58 to form a substantially flat carton. To assemble the carton into the housing 14, the base panel 22 is bent at its ends 24 and 26, so that the base panel 22 is flat, the rear panel 60 is substantially vertical, and the front portion 32 is inclined (see FIGS. 6 and 7). Next, the wing-shaped panels 36 are folded upwardly to a substantially vertical position, and the side portions 42 are folded downwardly from the inclined front panel 40 so as to overlap the upwardly extending wing-shaped panels 36. Assembly is completed by bending the side flaps 54 inwardly and inserting them between the rear panel 60 and the edges of the wing-shaped panels 36. It can now be appreciated that the wedge-shaped housing 14 comprises a base panel 22 for supporting the housing 14 on a supporting surface, an inclined front panel 40 extending upwardly and rearwardly from the base panel 22, a substantially vertical rear panel 60, and two triangular side panels 52. The inclined front panel 40 has a rectangular display opening 44 formed therein, and the rear panel 60 includes a slot 64 adjacent to the base panel 22. It can also be appreciated that the cover panel 62 is connected to the rear panel 60 at crease line 58 so that it is hingeably movable between a closed or shipping position illustrated in FIG. 2, and an open or display position illustrated in FIG. 1. The tab 66 at the terminal end of the cover panel 62 is operative for securing the cover panel 62 either to the front panel 40 or to the rear panel 60. In the closed position (FIG. 2), the cover panel 62 is bent forwardly so that it lies adjacent to the inclined front panel 40 and covers the display opening 44. The cover panel 62 is maintained in the closed position by interlocking the tab 66 with the lower edge of the display opening 44. In the display position (FIG. 1), the cover panel 62 is bent rearwardly so that it lies adjacent to the rear panel 60, and it is maintained in the open position by interlocking the tab 66 in the slot 64 (FIG. 6).

Figure 5:
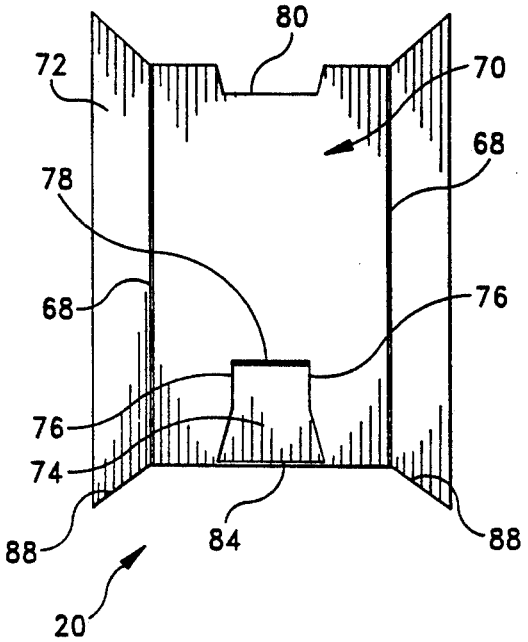
FIG. 5 is a plan view of the paperboard blank that is folded to form the easel-like member.

Referring now to FIG. 5, the paperboard display blank 20 comprises a generally rectangular sheet having two spaced, parallel crease lines 68 which divide the blank 20 into a center display panel generally indicated at 70, and two side flaps 72 on opposite sides of the display panel 70. A flap 74 is formed at one end of the display panel 70 by two longitudinally extending cut lines 76 and a lateral crease line 78. The display panel 70 further includes a rectangular notch 80 at the opposite end thereof.

Figure 4:
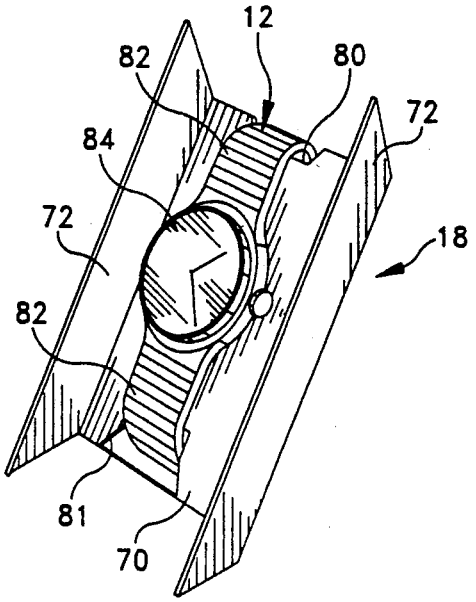
FIG. 4 is a perspective view of the easel member of the watch display package.
Figure 7:
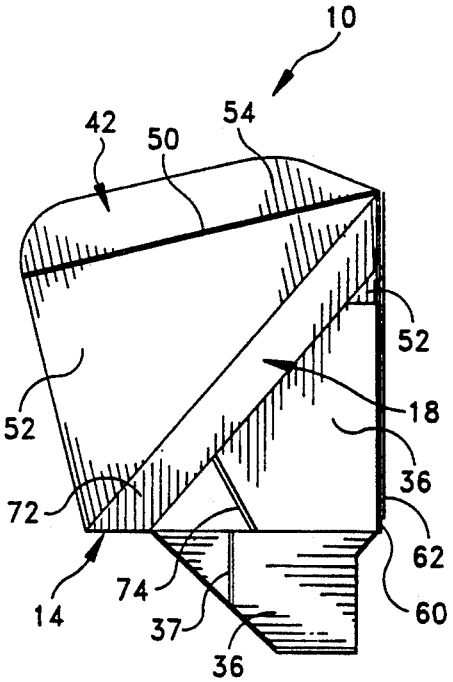
FIG. 7 is a side elevational view thereof with the side panels unfolded, and the easel-like display member positioned within the housing.

To form the display member 18, the side flaps 72 are folded forwardly along crease lines 68 as illustrated in FIG. 4. It can therefore be appreciated that the easel-like display member 18 comprises an inclined display panel 70 which extends upwardly and rearwardly so as to be positioned substantially parallel to the inclined front panel 40 of the housing 14 when inserted therein. The flap 74 in the display panel 70 is bent rearwardly to provide a notch which is operative for receiving a watchband 82. The two side flaps 72 extend forwardly from the display panel 70 to provide a proper spacing of the display panel 70 and the front panel 40. The display member 18 is operative for holding the watch 12 as illustrated in FIG. 4, wherein the watchband 82 is received in the notches 80 and 81, and then secured to itself in a conventional manner. The notches 80 and 81 are operative for maintaining the watch 12 in a substantially vertical display position. The display member 18 is inserted into the housing 14 through one of the sides as illustrated in FIG. 7, and it is operative for holding the watch 12 so that the face 84 thereof is aligned with the display opening 44.

It is seen therefore that the instant invention provides an effective watch display package 10 which is operative for alternately displaying and enclosing a wristwatch 12. The package 10 is formed from folded paperboard blanks 16 and 20 respectively, and therefore, it is relatively inexpensive to manufacture and assemble compared to the prior art watch display packages. The package 10 includes a cover panel 62 which is hingeably connected to the housing 18 and which is moveable between a closed position for shipping, and an open position for display. Still further, the paperboard package 10 is lightweight, reusable, and environmentally safe. For these reasons, it is believed that the paperboard watch display package of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A package construction for alternatively displaying and enclosing a wristwatch comprising:

a generally wedge-shaped housing having an inclined front panel, a rear panel and a display opening in said front panel;

an easel-like display member received in said housing, said display member being operative for holding said watch with the face thereof aligned with said display opening; and a cover panel hingeably attached to said housing, said cover panel being hingeably moveable between a first position wherein said cover panel lies adjacent to said front panel and covers said display opening and a second position wherein said cover panel lies adjacent to said rear panel, whereby said watch is viewable through said display opening.

2. In the package construction of claim 1, said housing further including means for releasably securing said cover panel in said first position.

3. In the package construction of claim 1, said housing further including means for releasably securing said cover panel in said second position.

4. In the package construction of claim 2, said cover panel including a tab, said tab interlocking with an edge of said display opening when in said first position.

5. In the package construction of claim 4, said rear panel including a slot therein, said tab interlocking with said slot in said second position.

6. In the package construction of claim 1, said display member comprising:

an inclined display panel having opposite ends, said panel being positioned substantially parallel to said housing front panel; and a notch at each end of said display panel for receiving the band of said watch.

7. A package construction comprising a generally wedge-shaped housing having a base panel;

first and second inner side panels extending upwardly from said base panel;

an inclined front panel extending upwardly and rearwardly from said base panel, said front panel having a display opening formed therein;

first and second outer side panels extending downwardly from said front panel so as to overlap said inner side panels;

two side flaps extending inwardly from said outer side panels;

a rear panel extending upwardly from said base panel so as to overlap said side flaps;

a cover panel attached to said housing, said cover panel being moveable between a first position wherein said cover panel lies adjacent to said front panel and a second position wherein said cover panel lies adjacent to said rear panel; and means for releasably securing said cover panel to said front panel.

8. In the package construction of claim 7, said housing further including means for releasably securing said cover panel to said rear panel.

9. In the package construction of claim 7, said housing further including a top flap extending downwardly from said front panel, said top flap having adhesive means thereon, said rear panel overlapping said top flap and being secured to said adhesive means.

10. In the package construction of claim 7, said cover panel including a tab, said tab interlocking with an edge of said display window in said first position.

11. In the package construction of claim 10, said rear panel including a slot adjacent the bottom panel, said tab interlocking with said slot in said second position.

12. The package construction of claim 7 further comprising an easel-like display member for holding an article in said package construction.

13. In the package construction of claim 12, said easel-like member comprising:

an inclined display panel having opposite ends, said display panel extending upwardly and rearwardly so as to be positioned substantially parallel to said housing front panel; and a notch at each end of said display panel.

14. In the package construction of claim 13, said easel-like member further including two side flaps extending forwardly from said display panel toward said housing front panel.

15. In the package construction of claim 7, said cover panel being hingeably connected to said rear panel.

16. A blank for a package construction comprising:

a base panel having first and second ends and opposite sides;

two inner side panels respectively extending outwardly from the opposite sides of said base panel;

a rectangular front panel extending outwardly from the first end of said base panel, said front panel including a first end adjacent said base panel, an opposite second end, and opposite sides, said front panel further having a window formed therein;

a top flap extending outwardly from the second end of said front panel;

two triangular side panels respectively extending outwardly from the opposite sides of said front panel;

side flaps extending outwardly from said side panels;

a rectangular rear panel extending outwardly from the second end of said base panel, said rear panel having a first end adjacent said base panel and an opposite second end, and further including a slot formed therein adjacent said first end thereof; and a rectangular cover panel extending outwardly from the second end of said rear panel.

17. In the blank of claim 16, said top flap including a pressure sensitive adhesive means thereon.

18. In the blank of claim 16, said cover panel having a first end foldably connected to the second end of said rear panel, and an opposite second end, said cover panel further including a tab extending outwardly from the second end thereof.

* * * * *